US005842623A

United States Patent [19]

Dippold

[11] Patent Number: 5,842,623

[45] Date of Patent: Dec. 1, 1998

[54] GAS PRIMED POWDER ACTUATED TOOL

[75] Inventor: Jack D. Dippold, Edwardsville, Ill.

[73] Assignee: Olin Corporation, East Alton, Ill.

[21] Appl. No.: 876,584

[22] Filed: Jun. 16, 1997

[51] Int. Cl.[6] ..... B25C 1/14

[52] U.S. Cl. ..... 227/10; 89/1.14

[58] Field of Search ..... 227/9, 10; 89/1.14; 102/202.8

[56] References Cited

U.S. PATENT DOCUMENTS

| | | | |
|---|---|---|---|
| 2,987,967 | 6/1961 | Wild et al. . | |
| 3,162,123 | 12/1964 | Turner . | |
| 3,195,407 | 7/1965 | Turner . | |
| 3,202,055 | 8/1965 | Butler et al. . | |
| 3,283,657 | 11/1966 | Kvavle . | |
| 3,302,319 | 2/1967 | Rosselet . | |
| 3,494,531 | 2/1970 | Seghezzi | 227/9 |
| 3,514,025 | 5/1970 | Hsu et al. . | |
| 3,659,768 | 5/1972 | Brunelle . | |
| 3,777,382 | 12/1973 | Brunelle . | |
| 3,981,424 | 9/1976 | Maier | 227/10 |
| 4,073,362 | 2/1978 | Airhart . | |
| 4,138,788 | 2/1979 | Jochum | 227/10 |
| 4,159,070 | 6/1979 | Monson . | |
| 4,200,213 | 4/1980 | Liesse . | |
| 4,332,340 | 6/1982 | Harris . | |
| 4,374,567 | 2/1983 | Combette et al. . | |
| 4,405,072 | 9/1983 | Kindle et al. | 227/10 |
| 4,410,124 | 10/1983 | Buechel . | |
| 4,611,738 | 9/1986 | Jochum | 227/9 |
| 4,717,060 | 1/1988 | Cotta . | |
| 4,721,240 | 1/1988 | Cotta . | |
| 4,739,915 | 4/1988 | Cotta . | |
| 4,773,581 | 9/1988 | Ohtsu et al. . | |
| 4,883,211 | 11/1989 | Philipp et al. . | |
| 4,954,078 | 9/1990 | Nelson . | |
| 5,038,665 | 8/1991 | Aske et al. . | |
| 5,167,736 | 12/1992 | Mei et al. . | |
| 5,199,626 | 4/1993 | Terayama et al. . | |
| 5,375,585 | 12/1994 | Home . | |
| 5,417,160 | 5/1995 | Mei et al. . | |
| 5,471,903 | 12/1995 | Brede et al. . | |
| 5,544,800 | 8/1996 | Armstrong . | |
| 5,558,264 | 9/1996 | Weinstein . | |

FOREIGN PATENT DOCUMENTS

| | | | |
|---|---|---|---|
| 2417967 | 11/1974 | Germany | 227/10 |

OTHER PUBLICATIONS

Material Safety Data Sheet. MAPP®Gas. Victor Equipment Co. P.O. Drawer 1007, Denton, TX 78202. Product Name: "Liquified Petroleum Gas with Methyl Acetylene–Propadien (0916–0009)" (Revised) Jan. 1, 1995.

*Primary Examiner*—Stephen F. Gerrity
*Attorney, Agent, or Firm*—Gregory S. Rosenblatt; Wiggin & Dana

[57] ABSTRACT

There is provided a powder actuated tool effective to drive a metallic fastener into a workpiece, for example, a nail gun. The pressure to drive the fastener is generated by combustion of an flammable propellant mix that is ignited by a primer flash. The primer flash having been generated by ignition of a combustible gas by discharge of an electric arc in the tool barrel. The combustible gas is lead-free such that the operator and the environment are not exposed to dangerous lead residue during use. The use of a solid propellant generates higher pressure and more effective driving of the metallic fastener than is achieved with powder actuated tools driven solely by combustible gases.

20 Claims, 5 Drawing Sheets

GAS PRIMED POWDER ACTUATED TOOL

BACKGROUND OF THE INVENTION

1. Field of the Invention

This invention relates to a powder actuated tool for driving a metallic article. One exemplary powder actuated tool is a nail gun. More particularly, the force that drives the metallic article is generated by combustion of a solid propellant charge ignited by a lead-free mixture of priming gases.

2. Description of the Related Art

Powder actuated tools are used to drive metallic fasteners into a workpiece. An example of a powder actuated tool is a nail gun, widely used in the construction industry. In a typical powder actuated tool, a propulsive force generated by combustion of a propellant drives a piston that pushes the metallic fastener into the workpiece. A spring or other means then returns the piston to the ready position for another cycle.

Typically, the propellant is gun powder contained within a conventional rimfire or centerfire shell. At the base of the shell is disposed a percussive (impact sensitive) primer mixture that includes lead styphnate. Activating a trigger mechanism causes a spring loaded hammer to crush the percussive mixture causing it to ignite. The hot primer gases then ignite the propellant.

Due to concerns with the exposure of workers to lead and with lead in the environment, there is a desire to develop a lead-free priming system for powder actuated tools. One approach is to utilize percussive primers that are lead-free. Exemplary of such primers are those disclosed in U.S. Pat. No. 5,167,736 by Mei et al., a mixture of diazodedinitrophenol (dinol) and boron, and in U.S. Pat. No. 5,417,160 also by Mei et al., an explosive powder that includes dinol mixed with a pyrotechnic powder wherein the pyrotechnic powder comprises calcium silicide and an oxidizer.

While the Mei et al. primers are lead-free, the exhaust products, notably boron oxide or silicon dioxide, may accumulate within the barrel of the powder actuated tool. Over time, the combustion products can interfere with proper operation of the tool.

The elimination of a percussive primer is disclosed in U.S. Pat. No. 3,514,025 by Hsu et al. The patent discloses an electrical resistance wire that ignites the propellant. However, shock and recoil experienced during use of the powder actuated tool has a tendency to loosen the ignition wire reducing the durability and reliability of such a tool.

U.S. Pat. No. 5,471,903 to Brede et al. is incorporated by reference in its entirety herein. The patent discloses a cartridge containing a primary propellant and a propellant wafer located behind the primary propellant. Adiabatic compression of a gas generates heat to ignite the propellant wafer. However, the temperature of the pressure cylinder where gas compression occurs affects performance and predicable results are difficult to obtain.

Accordingly, there remains a need for a powder actuated tool having a lead-free priming mechanism that does not suffer from the disadvantages of the prior art.

SUMMARY OF THE INVENTION

It is an object of the invention to provide a powder actuated tool for driving a metallic fastener into a workpiece. It is a feature of the invention that the combustion of a solid propellant generates a pressure effective to drive the fastener. It is another feature of the invention that the solid propellant is contained within a housing having an open end. Combustion of an ignitable primer gas adjacent to the open end ignites the solid propellant.

One advantage of the invention is that the primer is lead-free, eliminating exposure of the operator to lead-containing combustion products and preventing the introduction of lead contaminants to the environment. Another advantage of the invention is that the combination of the solid propellant and gaseous primer generates a higher pressure than a gas only or other pneumatically actuated tool. Since the quantity of gas required is considerably less than that required with a pneumatically actuated tool, temperature increase in the tool chamber during extended use is minimized reducing the need for external cooling. Further, the volume of spent gas is minimized reducing the need for complex venting apparatus.

In accordance with the invention, there is provided an apparatus for driving a metallic article into a solid surface. The article includes a housing having an open end and a generally cylindrical interior bore extending from that open end. The bore has respective first, second and third diameters where the first diameter is adjacent to the open end and is effective to receive a work piston. The second diameter is in opposition to the open end and is effective to receive a flammable propellant mix. The third diameter is less than either of the respective first or second diameters and is disposed between the first and second diameters. A conduit extends through the housing to the third diameter and is effective to deliver an ignitable gaseous product to the third diameter. Also contained within the third diameter is an ignition source.

The above stated objects, features and advantages will become more apparent from the specification and drawings that follow.

IN THE DRAWINGS

DETAILED DESCRIPTION

Figure 1:
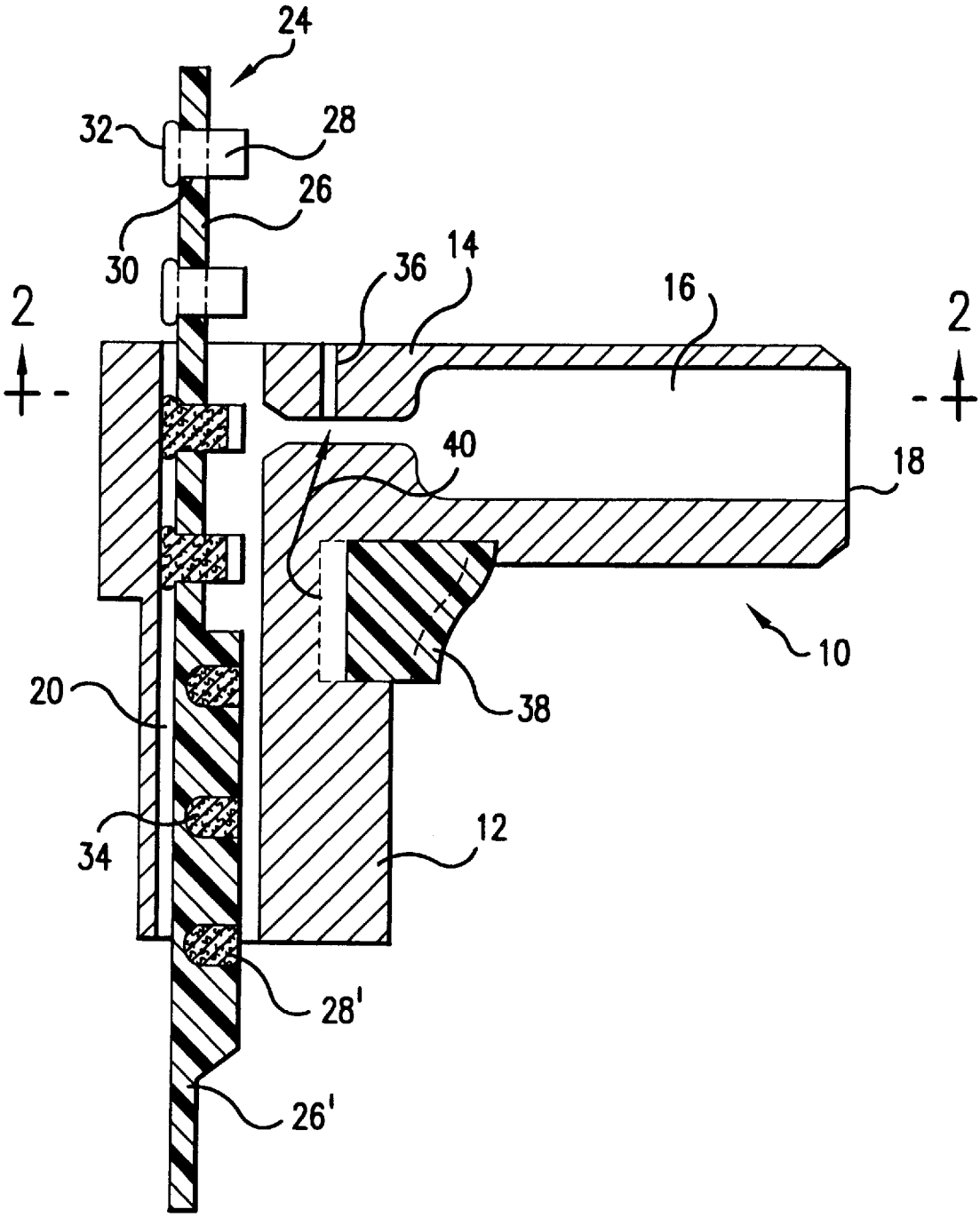
FIG. 1 shows in cross-sectional representation a powder actuated tool in accordance with the invention.

FIG. 1 illustrates in cross-sectional representation a powder actuated tool 10 in accordance with the invention. Such tools are designed to drive a metallic fastener (not shown), such as a nail, into a workpiece. The powder actuated tool 10 resembles a hand gun and has a handle 12 intersecting a barrel 14. Typically, both the handle 12 and the barrel 14 are formed of metal, plastic or rubber. The barrel 14 has a generally cylindrical interior bore 16 that terminates at an open end 18 corresponding to the muzzle of the powder actuated tool. A slot 20 extends through the handle 12 and is sized to receive a cartridge strip magazine 24. The cartridge strip magazine 24 includes a metal or plastic cartridge strip 26 supporting a plurality of cartridges 28.

In one embodiment of the invention, the cartridges 28 are formed from small caliber ammunition shells, 0.22 caliber cartridge brass (nominal composition by weight—70% copper, 30% zinc) shells are exemplary. The cartridges 28 extend through circular apertures 30 formed in the cartridge strip 26 of a size effective to hold the cartridge 28 in place by friction. It is not necessary to form an aperture in the base 32 of the cartridge 28 to receive a primer.

In an alternative embodiment of the invention, the cartridge 28' is either molded directly in a plastic cartridge strip 26' or is formed from a combustible material.

Cartridges 28, 28' are filled with a suitable flammable propellant mix 34. The flammable propellant mix is any suitable material such as granular single base gunpowder or granular double base gunpowder. Other suitable propellants include gas generating propellants such as nitrocellulose and sodium azide.

In operation of the powder actuated tool 10, the cartridge strip magazine 24 is inserted into slot 20 by an operator. An indexing means aligns a cartridge with the interior bore 16. The cartridge is then fired, providing the propulsive force necessary to drive the metallic fastener.

A conduit 36 provides access to a portion of the interior bore 16 disposed between the muzzle 18 and the chambered cartridge 28. The conduit 36 introduces a combustible gas to the interior bore. When the operator manually depresses a trigger 38, an electric impulse is generated and conducted 40 to the interior bore 16 generating a spark that ignites the combustible gas. The combustible gas ignites the flammable propellant mix 34 contained within cartridges 28 rapidly generating a volume of gas effective to generate a pressure to drive the fastener into a workpiece.

Figure 2:
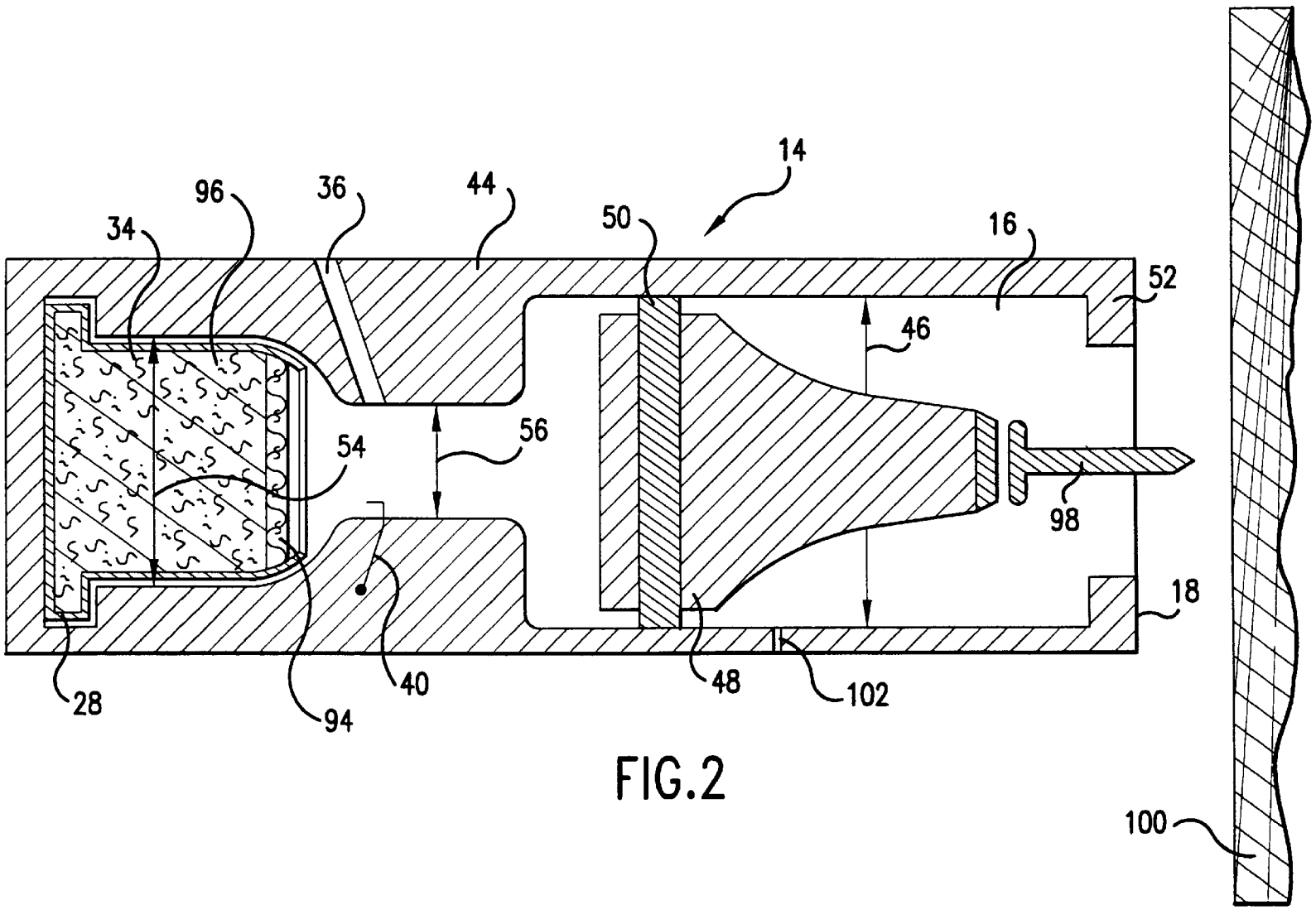
FIG. 2 shows in cross-sectional representation the barrel portion of the powder actuated tool of FIG. 1.

FIG. 2 illustrates in cross-sectional representation the powder actuated tool of FIG. 1 along barrel 14. The barrel 14 has a housing 44 terminating at an open end 18 at the muzzle end of the powder actuated tool. The generally cylindrical interior bore 16 has a first diameter 46 adjacent to the open end 18. The first diameter 46 is of a size effective to receive a work piston 48. The work piston 48 is formed from any hard material that will not be deformed by the forces generated during actuation of the powder actuated tool. A typical material for the work piston 48 is a work hardened, impact resistant steel. The work piston 48 generally has a diameter slightly less than the first diameter 46 and is provided with an obturation band or piston seal ring 50. The piston seal ring 50 can be formed from a compressible spring steel having low friction and is typically fit within a circumferential groove formed in the work piston 48. A stop 52 at the muzzle reduces the diameter of the bore to retain the work piston 48 within the bore.

In opposition to the first diameter 46 is a second diameter 54 that intersects the slot forming a chamber to receive the next cartridge to be fired. The second diameter 54 is of a size and shape effective to receive and chamber the cartridge 28. Disposed between the first diameter 46 and the second diameter 54 is a third diameter 56 portion of interior bore 16. The third diameter 56 is less than both the first diameter 46 and the second diameter 54. The conduit 36 extends to the third diameter 56 for delivery of a combustible gas to the third diameter portion. The electrical conductor 40 provides a voltage effective to generate a spark to the third diameter portion.

Figure 3:
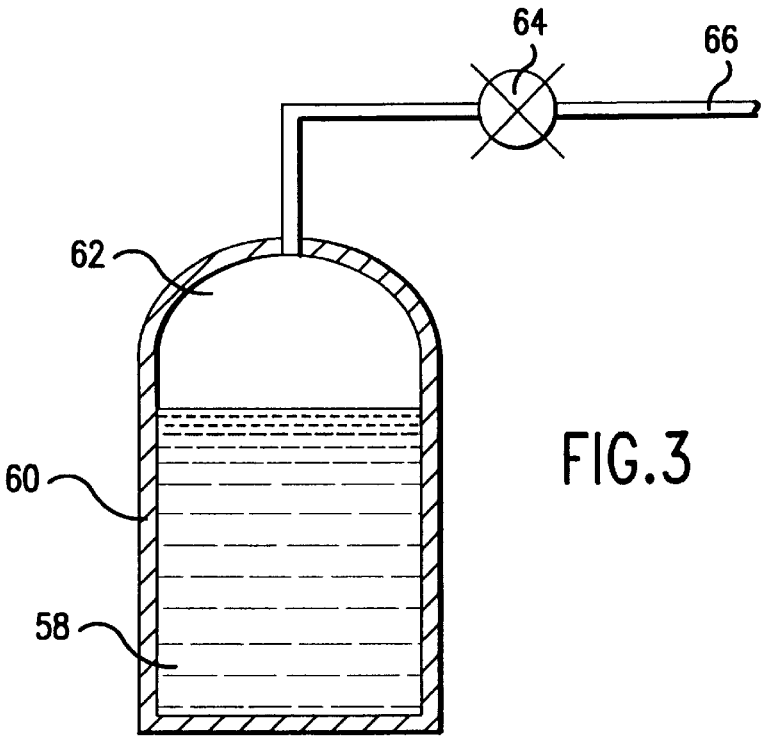
FIGS. 3 and 4 illustrate priming gas sources.

With reference to FIG. 3, in one embodiment of the invention, the combustible gas is supplied as compressed liquid 58 such as MAPP (methyl acetylene propadien). The liquid 58 is contained within a pressurized cylinder 60 at an equilibrium pressure effective to provide a volume of gas 62. A regulator 64 controls the flow of the pressurized gas 62 to an outlet 66, such as a flexible hose, joined to the conduit (36 not shown) of the powder actuated tool by any suitable gas tight fitting.

The removal of gas 62 from the pressurized cylinder 60 to the powder actuated tool reduces the pressure in the pressurized cylinder 60 causing a portion of the compressed liquid to boil, increasing the volume of gas and returning the pressure to equilibrium. The use of a compressed liquid as the pressure medium facilitates the storage of a larger quantity of gas than when stored as a compressed gas.

Figure 4:
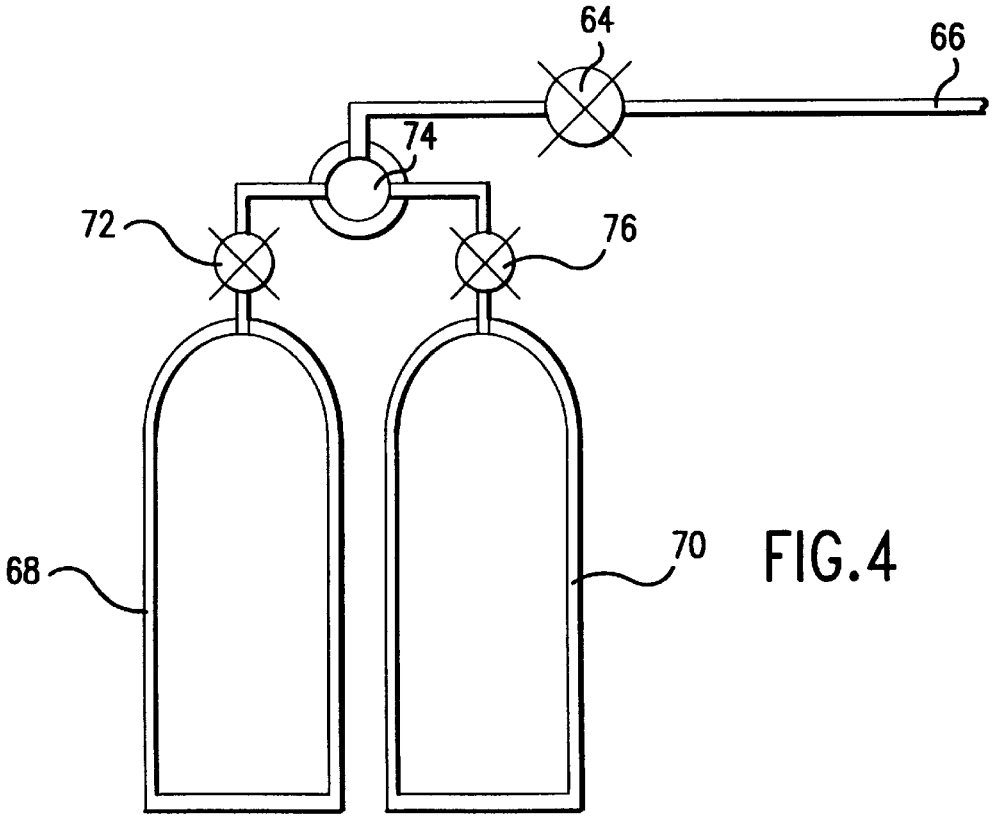

In another embodiment, illustrated in FIG. 4, a gas cylinder 68 contains a pressurized combustible gas such as butane, propane, propylene or ethane. Regulator 64 controls the flow of the combustible gas to outlet 66 for delivery to conduit (36 not shown).

Alternatively, a second gas cylinder 70 is provided containing a second gas. For example, the first gas may be hydrogen and the second gas may be oxygen. A first regulator 72 controls the flow of the first gas into a mixing chamber 74 while a second regulator 76 controls the flow of the second gas into the mixing chamber 74. The gaseous mixture is then delivered through outlet 66 to the conduit (36 not shown).

Figure 5:
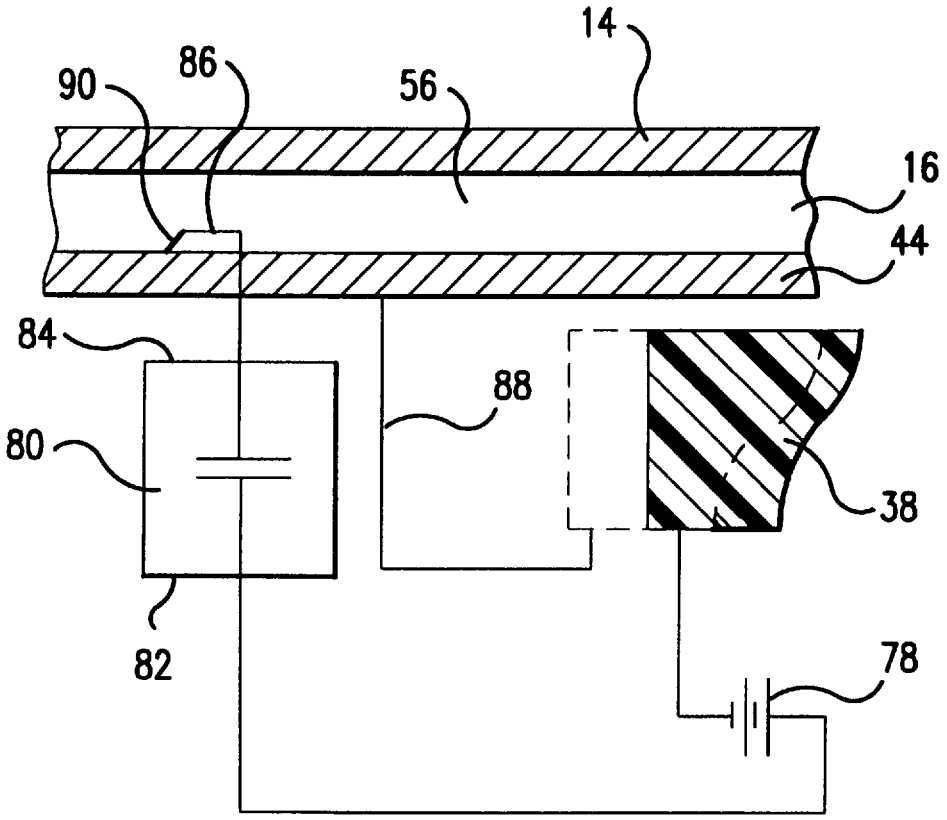
FIGS. 5 and 6 illustrate systems to ignite the priming gas.

The combustible gas is delivered to the third conduit portion and ignited by a spark. FIG. 5 illustrates a first spark generating source. A power supply 78, for example a alkaline battery contained within the handle of the powder actuated tool, charges capacitor 80. A first end 82 of capacitor 80 is electrically interconnected to the power supply 78. A second end 84 of the capacitor 80 is electrically interconnected to an electrode 86 disposed within the third diameter 56 portion of barrel 14.

An isolated lead 88 that may contact the housing 44, if the housing 44 is electrically conductive, or extend into the interior bore 16, if the housing 44 is not electrically conductive, completes the circuit. When the trigger 38 is depressed, to the alternate position indicated by broken lines, the electrical circuit is completed, causing capacitor 80 to discharge as an electric arc 90. The electric arc 90 extends between the electrode 86 and a proximate ground to ignite the combustible gas contained by the third diameter 56 creating a priming flash.

Figure 6:
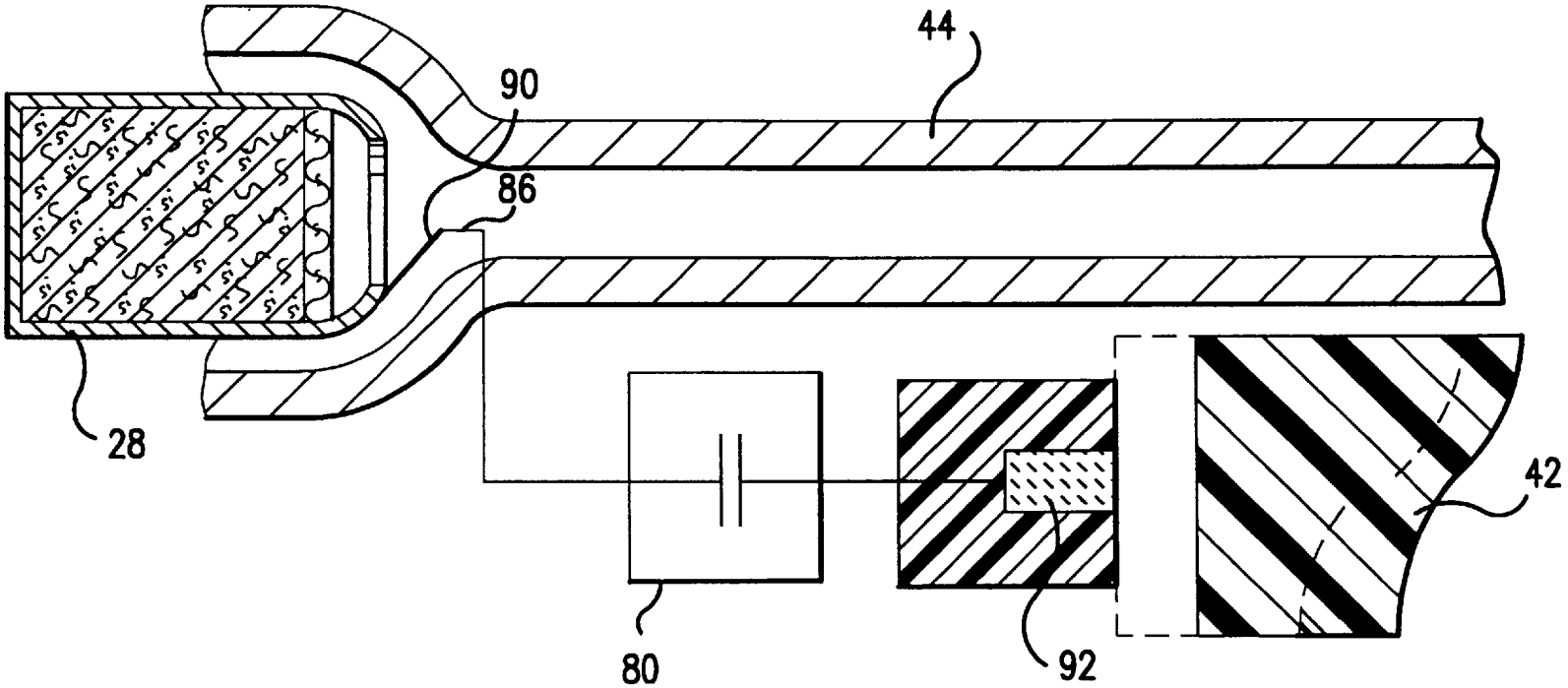

An alternative method of generating the priming flash is illustrated in FIG. 6. Depression of trigger 38 compresses a piezoelectric crystal 92 causing a current to flow and providing the voltage necessary to charge capacitor 80. When the capacitor 80 is sufficiently charged, an electric arc 90 extends from electrode 86 to either a grounded portion of the housing 44 or to a grounded metallic cartridge 28. The electric arc 90 ignites the combustible gas providing a priming flash. One piezoelectric spark igniter system is disclosed in U.S. Pat. No. 4,954,078 to Nelson that is incorporated by reference in its entirety herein.

It is within the scope of the invention to direct the electric arc directly to the propellant mix contained within the metallic cartridge 28 eliminating the need for a combustible gas primer.

With reference back to FIG. 2, the priming flash either ignites the flammable propellant mix 34 contained within the cartridge 28 or first ignites an ignitable closure disk 94 such as a combustible nitrocellulose wad. The closure disk 94 is desirable to retain a granular flammable propellant mix within the cartridge 28 and to minimize moisture permeation.

It is also within the scope of the invention to coat interior surfaces 96 of the cartridge 28 with an ignitable material such as a lacquer.

Ignition of the flammable propellant mix 34 generates a rapidly moving high pressure wave that drives work piston 48 into a metallic fastener 98 driving the metallic fastener 98 into a workpiece 100. A vent 102 opened by movement of the piston ring 50 past vent 102 releases the pressure and expels gaseous combustion products. A compression spring (not shown), or other suitable means, then returns the work piston 48 back to its original position to repeat the cycle.

The flammable propellant mix is ignited at the open end of the cartridge and burns rearward therefrom, towards the closed end of the cartridge. The burning direction results in most combustion debris being deposited within the cartridge rather than being expelled into the powder actuated tool barrel.

It is apparent that there has been provided in accordance with the present invention a powder actuated tool having a lead-free primer that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modification and variations as fall within the spirit and broad scope of the appended claims.

I claim:

1. An apparatus for driving a metallic article into a surface, comprising:

a powder actuated tool having a barrel and intersecting handle, said barrel having an open, muzzle, end with a generally cylindrical interior bore extending therefrom, said generally cylindrical interior bore having respective first, second, and third diameter portions wherein said first diameter portion is adjacent to said open, muzzle, end and is effective to receive a work piston, said second diameter portion is in opposition to said open, muzzle, end and is effective to receive a cartridge containing a flammable propellant mix, and said third diameter portion has a diameter less than either of said respective first or second diameters and is disposed therebetween;

a conduit extending through said barrel to said third diameter portion and being effective to deliver a combustible gas to said third diameter portion; and an ignition source within said third diameter portion.

2. The apparatus of claim 1 wherein said ignition source is the combination of an electrode extending into said third diameter portion and a proximate ground.

3. The apparatus of claim 2 wherein said ignition source further includes a power supply and a capacitor effective to generate a spark between said electrode and said ground on discharge.

4. The apparatus of claim 3 wherein said power supply is a battery contained within the handle of said apparatus.

5. The apparatus of claim 3 wherein said power supply is a piezoelectric crystal contained within the handle of said apparatus.

6. The apparatus of claim 3 wherein said barrel is metallic and constitutes said ground.

7. The apparatus of claim 3 wherein said barrel is plastic and said ground is an isolated lead.

8. The apparatus of claim 3 wherein said cartridge is metallic and constitutes said ground.

9. The apparatus of claim 3 wherein said cartridge is formed from brass.

10. The apparatus of claim 9 wherein an inner bore of said cartridge is coated with a flammable material.

11. The apparatus of claim 10 wherein said inner bore is coated with a lacquer.

12. The apparatus of claim 3 wherein said cartridge is plastic.

13. The apparatus of claim 3 wherein said combustible gas is selected from the group consisting of methyl acetylene propadien, propane, butane, propylene, ethane and mixtures thereof.

14. The apparatus of claim 13 wherein said combustible gas is interconnected to said third diameter portion by said conduit.

15. The apparatus of claim 14 wherein said combustible gas is methyl acetylene propadien.

16. The apparatus of claim 3 wherein said combustible gas is a mixture of at least two gases.

17. The apparatus of claim 16 wherein said combustible gas is a mixture of hydrogen and oxygen.

18. An apparatus for driving a metallic article into a surface, comprising:

a powder actuated tool having a barrel and intersecting handle, said barrel having an open, muzzle, end with a generally cylindrical interior bore extending therefrom, said generally cylindrical interior bore having respective first, second, and third diameter portions wherein said first diameter portion is adjacent to said open, muzzle, end and is effective to receive a work piston, said second diameter portion is in opposition to said open, muzzle, end and is effective to receive an electrically grounded metallic cartridge containing an explosive propellant mix, and said third diameter portion has a diameter less than either of said respective first or second diameters and is disposed therebetween; and an ignition source within said third diameter portion.

19. The apparatus of claim 18 wherein said ignition source is the combination of an electrode extending into said third diameter portion and proximate to said electrically grounded metallic cartridge.

20. The apparatus of claim 19 wherein said ignition source further includes a power supply and a capacitor effective to generate a spark between said electrode and said electrically grounded metallic cartridge on discharge.

* * * * *